United States Patent [19]

Pickering

[11] Patent Number: 4,832,340

[45] Date of Patent: May 23, 1989

[54] GOLF CLUB

[75] Inventor: Russell J. Pickering, Bryan, Ohio

[73] Assignee: Shurfire Sports International, Inc., Bryan, Ohio

[21] Appl. No.: 165,515

[22] Filed: Mar. 8, 1988

[51] Int. Cl.[4] ..... A63B 53/02

[52] U.S. Cl. ..... 273/80.2; 273/80 C

[58] Field of Search ..... 273/80.2, 80.3, 80.4, 273/80.5, 80.6, 80.7, 80.8, 80.9, 167 R, 167 F, 169, 170–174

[56] References Cited

U.S. PATENT DOCUMENTS

| | | | |
|---|---|---|---|
| 753,677 | 3/1904 | Curtiss | 273/80.2 |
| 794,488 | 7/1905 | Burke | 273/80.2 |
| 1,537,320 | 5/1925 | Marsh | 273/80.2 |
| 1,980,031 | 11/1934 | Brading | 273/80.6 |
| 2,457,177 | 12/1948 | Reach | 273/80.2 |
| 3,266,805 | 8/1966 | Bulla | 273/78 |
| 3,572,709 | 3/1971 | Risher | 273/80.2 |
| 3,825,991 | 7/1974 | Cornell | 273/80.2 |
| 3,934,875 | 1/1976 | Easton et al. | 273/80.2 |
| 3,980,301 | 9/1976 | Smith | 273/80.2 |
| 3,992,015 | 11/1976 | Benson | 273/80.2 |
| 4,063,737 | 12/1977 | Tom et al. | 273/174 |
| 4,324,404 | 4/1982 | Dian | 273/169 |
| 4,438,931 | 3/1984 | Motomiya | 273/167 H |
| 4,597,577 | 7/1986 | Lamanna | 273/80.1 |

*Primary Examiner*—George J. Marlo

*Attorney, Agent, or Firm*—MacMillan, Sobanski & Todd

[57] ABSTRACT

A golf club hosel includes a hollow cylindrical recess formed therein extending from an open end to a closed bottom end. An inner diameter of predetermined size is defined by the recess. At the bottom end of the recess, a generally cylindrical protrusion is formed. The protrusion extends upwardly co-axially within the recess. The protrusion includes a first tapered outer surface extending upwardly from the bottom end and a second tapered outer surface extending upwardly from the first tapered outer surface. The first tapered outer surface is tapered at a relatively small angle relative to the recess, while the second tapered outer surface is tapered at a relatively large angle. When an open end of a hollow cylindrical shaft is inserted within the hosel, such open end is received in a generally annular space defined between the outer surface of the protrusion and the inner surface of the recess. An adhesive is used to secure the hollow shaft to the outer surface of the protrusion and the inner surface of the recess.

6 Claims, 1 Drawing Sheet

GOLF CLUB

BACKGROUND OF THE INVENTION

The present invention relates in general to golfing equipment and in particular to an improved structure for a hosel of a golf club head.

Golf is a sport which is played throughout the world by persons of all ages. The clubs which are used in the game of golf are typically formed having a shaft connected to a head. Many golf club heads are formed having an integral hosel, which is a socket formed in the head into which the shaft is inserted. Known constructions for hosels are hollow and cylindrical in shape, having inner diameters which are slightly larger than the outer diameters of the cylindrical shafts inserted therein. Adhesives are frequently used to attach the end of the shaft inserted within the hosel to the head so as to form the golf club.

Obviously, it is important that the shaft of the golf club be precisely aligned with the head when it is attached thereto so that the club will properly strike the golf ball during use. Known constructions for hosels are prone to misalignment because of the relative diameters mentioned above. Thus, it would be desirable to provide some means for preventing such misalignment, while continuing to provide a structure which is easy to assemble. Relatively large forces are generated within the hosel when the head of the golf club strikes the golf ball. Known structures for hosels are subject to failure because of these forces. Thus, it would also be desirable to strengthen the junction between the shaft and the head.

SUMMARY OF THE INVENTION

The present invention relates to an improved structure for a hosel of a golf club head. The hosel is formed integrally with the head and includes a hollow cylindrical recess formed therein extending from an open end to a bottom end. An inner diameter of predetermined size is defined by the recess. At the bottom end of the recess, a generally cylindrical protrusion is formed. The protrusion extends upwardly co-axially within the recess. The protrusion includes a first tapered outer surface extending upwardly from the bottom end and a second tapered outer surface extending upwardly from the first tapered outer surface. The first tapered outer surface is tapered at a relatively small angle relative to the recess, while the second tapered outer surface is tapered at a relatively large angle. When an open end of a hollow cylindrical shaft is inserted within the hosel, such open end is received in a generally annular space defined between the outer surface of the protrusion and the inner surface of the recess. The protrusion guides the open end of the shaft so as to insure the proper alignment thereof within the hosel. The protrusion also strengthens the mechanical connection therebetween. Adhesives may be used to bond the shaft to the hosel.

It is an object of the present invention to provide an improved structure for a hosel of a golf club head.

It is another object of the present invention to provide such an improved hosel for a golf club head which is simple and inexpensive in construction.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENT

Figure 1:
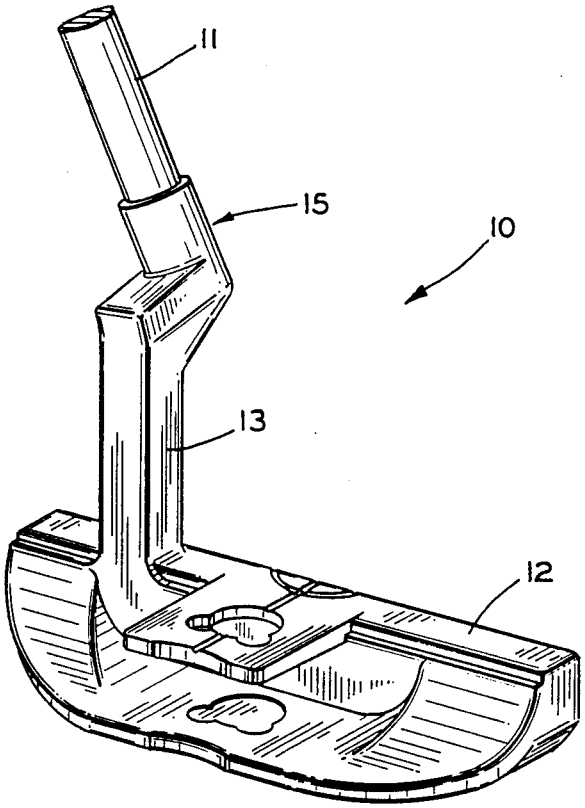
FIG. 1 is a perspective view of a portion of a golf club including the improved hosel of the present invention.
Figure 2:
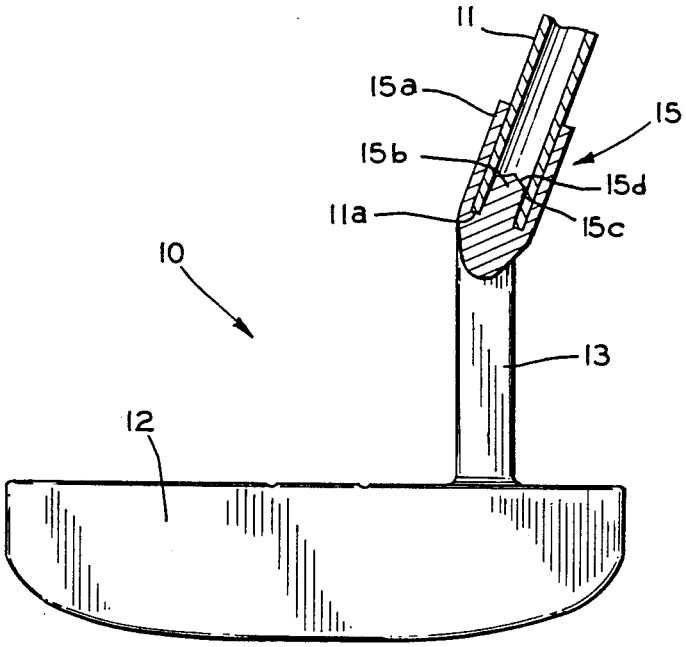
FIG. 2 is a sectional elevational view of the golf club illustrated in FIG. 1.

Referring now to the drawings, there is illustrated in FIGS. 1 and 2 a portion of a golf club, indicated generally at 10, in accordance with the present invention. The golf club 10 includes a shaft 11 and a head 12. Although the illustrated golf club 10 is a putter, it will be appreciated that the present invention may be used in connection with any type of golf club, such as a wood or an iron. The shaft 11 is generally hollow and cylindrical in shape and includes a lower open end 11*a*. The shaft 11 may have an outer diameter of approximately 0.360 inch and an inner diameter of approximately 0.270 inch. The head 12 includes an integral arm 13 which extends upwardly therefrom. A hosel, indicated generally at 15, is formed integrally with the upper end of the arm 13. The hosel 15 is angled relative to the arm 13. As will be explained in greater detail below, the open end 11*a* of the shaft 11 extends into the hosel 15 for attachment thereto.

FIG. 2 more clearly illustrates the structure of the hosel 15. As shown therein, the hosel 15 includes a hollow cylindrical outer portion 15*a* and an inner generally cylindrical protrusion 15*b*. The outer portion 15*a* and the inner protrusion 15*b* are both formed integrally with the arm 13. In fact, the entire head 12 may be formed from a single piece of material, such as die cast zinc. The outer portion 15*a* of the hosel 15 extends from an upper open end to a lower bottom end and defines an inner diameter throughout. The inner diameter of the outer portion 15*a* is slightly larger than the outer diameter of the shaft 11, approximately 0.361 inch, for example.

The inner protrusion 15*b* is formed having a first tapered outer surface 15*c*. The first tapered outer surface 15*c* extends upwardly from the bottom end of the hosel 15. The first tapered outer surface 15*c* tapers inwardly at a relatively small angle relative (1.5° for example) relative to the inner surface of the outer portion 15*a* as it extends upwardly from the bottom end of the hosel 15. The inner protrusion 15*b* is further provided with a second tapered outer surface 15*d*. The second tapered outer surface 15*d* extends upwardly from the top of the first tapered outer surface 15*c* to a point. The second tapered outer surface 15*d* tapers inwardly at a relatively large angle (59° for example) relative to the inner surface of the outer portion 15*a* as it extends upwardly. The outer diameter of the inner protrusion 15*b* at its largest point (which is at the junction thereof with the bottom end of the outer portion 15*a*) is slightly smaller than the inner diameter of the shaft 11, for example 0.269 inch.

To assemble the golf club 10, a conventional adhesive (not shown) is initially disposed within the hosel 15. The adhesive flows to the bottom of the outer portion 15*a* about the protrusion 15*b*. The open end 11*a* of the shaft 11 is then inserted into the open end of the hosel 15. The shaft 11 is received about the inner protrusion 15*b*, which guides the shaft 11 position as it is moved downwardly within the hosel 15. As the shaft 11 moves downwardly, the adhesive is pushed upwardly within the hosel 15, about both the outer and inner surfaces of the shaft 11. Thus, the shaft 11 is bonded to both the outer portion 15*a* and the inner protrusion 15*b* of the hosel 15. When the open end 11*a* of the shaft 11 engages the bottom end of the hosel 15, such open end 11*a* is automatically aligned with the hosel 15. As a result, the final alignment of the shaft 11 with the head 12 is simplified. Furthermore, the mechanical connection between the shaft 11 and the head 12 is strengthened because of the engagement of the inner protrusion 15*b* with the interior of the shaft 11.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A golf club comprising:

a head portion including a hosel connected thereto, said hosel including a hollow portion extending from a lower closed end to an upper open end and an integral protrusion extending upwardly from said closed end within said hollow portion, a portion of said protrusion tapering from a wider lower end to a narrower upper end;

a hollow shaft including an open end extending into said hollow portion of said hosel over said protrusion, said shaft having an inner surface and an outer surface; and an adhesive disposed between said inner surface of said shaft and said tapered portion of said protrusion and between said outer surface of said shaft and said hollow portion of said hosel for securing said shaft to both said outer portion and said protrusion.

2. The invention defined in claim 1 wherein said first tapered outer surface tapers inwardly as it extends upwardly from said bottom end at a relatively small angle relative to said outer portion.

3. The invention defined in claim 2 wherein said first tapered outer surface tapers inwardly at an angle of 1.5°.

4. The invention defined in claim 1 wherein said inner protrusion includes a second tapered outer surface extending upwardly from said first tapered outer surface.

5. The invention defined in claim 4 wherein said second tapered outer surface tapers inwardly as it extends upwardly from said first tapered outer surface at a relatively large angle relative to said outer portion.

6. The invention defined in claim 5 wherein said second tapered outer surface tapers inwardly at an angle of 59°.

* * * * *